US006026989A

United States Patent [19]

Richmond

[11] Patent Number: 6,026,989

[45] Date of Patent: Feb. 22, 2000

[54] MULTICHAMBER SQUEEZE TUBE INTEGRALLY MOLDED IN ONE PIECE AND CONTAINER ASSEMBLY INCORPORATING SAME

[75] Inventor: Thomas Michael Richmond, Evansville, Ind.

[73] Assignee: RXI Plastics, Inc., Triadelphia, W. Va.

[21] Appl. No.: 09/164,143

[22] Filed: Sep. 30, 1998

[51] Int. Cl.[7] ..... B65D 35/22

[52] U.S. Cl. ..... 222/94; 222/107

[58] Field of Search ..... 222/94, 129, 107

[56] References Cited

U.S. PATENT DOCUMENTS

| | | | |
|---|---|---|---|
| 3,227,319 | 1/1966 | Rosier | 222/94 |
| 4,211,341 | 7/1980 | Weyn | 222/94 |
| 4,461,403 | 7/1984 | Prahs | 222/129 |
| 5,076,470 | 12/1991 | Hatakeyama et al. | 222/94 |
| 5,324,505 | 6/1994 | Kornettka et al. | 424/49 |
| 5,328,056 | 7/1994 | Schneider et al. | 222/94 |
| 5,388,727 | 2/1995 | Jouillat | 222/94 |
| 5,647,510 | 7/1997 | Keller | 222/94 |

*Primary Examiner*—Gregory L. Huson
*Attorney, Agent, or Firm*—Richard V. Westerhoff; Eckert Seamans Cherin & Mellott, LLC

[57] ABSTRACT

A container for dispensing two flowable products in desired proportions includes a multichamber squeeze tube with a pair of nested tubes integrally molded with an end wall as a single piece. Apertures in the end wall provide dispensing openings for a first chamber inside the inner tube, and for a second chamber between the two tubes. Preferably, the two tubes have out of round cross-sections, generally ellipsoidal in configuration, and the outer tube has a cylindrical neck with a shoulder joining it to the out of round main section. The out of round inner tube extends up into the neck of the outer tube to the end wall and is integrally molded along a major axis to the shoulder of the outer tube. The single piece, two chamber squeeze tube is molded in a straight draw mold with a split mold piece only required to release external threads formed on the neck. A cap with internal threads screws onto the threaded neck.

20 Claims, 5 Drawing Sheets

MULTICHAMBER SQUEEZE TUBE INTEGRALLY MOLDED IN ONE PIECE AND CONTAINER ASSEMBLY INCORPORATING SAME

BACKGROUND OF THE INVENTION

1. Field of the Invention

This invention relates to squeeze containers with a removable cap for storing and dispensing flowable products and particularly to a multichamber squeeze tube in which nested tubes forming the chambers and an end wall with dispensing openings for each chamber are all integrally molded as a single piece.

2. Background Information

Containers formed of pliable resin which can be squeezed to dispense a flowable product are well known. Some of these containers have two or more chambers containing separate components which are mixed as they are dispensed. The known multichamber squeeze containers have a separate end piece which is preformed and then fixed to the separately formed tube sections or, in some cases, is molded to preformed tubular sections. In the latter case, the preformed tubes are supported in a mold which is then filled with flowable resin. The resin hardens to form the end piece in which the ends of the tubes are imbedded. In some cases, the end piece is complex and can have multiple pieces which require assembly. The multiple chambers are filled with the different flowable products from the opposite ends of the tubes which are then closed, usually by flattening and sealing. The end piece has dispensing openings for each of the chambers, typically sized to effect a desired mix of the flowable products which are dispensed by squeezing the tubes. The squeezing force applied to the outer tube is transmitted to the inner tube or tubes through the intervening flowable product or products.

These known multichamber squeeze tubes require separate steps to form the tubes, load them into a mold and then mold the dispensing end piece to engage the preformed tubes. In other cases, the tubes and end pieces are separately formed and then joined. In both cases, several steps are required to form a multichamber squeeze tube which adds to the cost and production time.

There is a need for an improved multichamber squeeze tube that can be made quickly and inexpensively.

More specifically, there is a need for such an improved multichamber squeeze tube that requires few steps and therefore less time to manufacture.

SUMMARY OF THE INVENTION

These needs and other are satisfied by the invention which is directed to a multichamber squeeze tube having at least two tubes with a first tube nested inside a second tube. The first chamber is formed inside the first tube and a second chamber is formed between the first and second tubes. An end wall extends across first ends of the first and second tubes to close off the first and second chambers. The tubes and the end wall are integrally molded as a single piece. The end wall is formed with at least one dispensing opening extending therethrough and aligned with the first chamber and at least one second dispensing opening extending therethrough and aligned with the second chamber. After the first chamber is filled with a first flowable fluid and the second chamber is filled with a second flowable fluid through the second ends, the second ends of the tubes are closed off, preferably by flattening and sealing.

The first tube has an inner surface which tapers outwardly from a first end adjacent the end wall toward a second or free end at a first angle and an outer surface which tapers inward at a second angle. The second tube has an inner surface which tapers outward from the first end toward the second end at a third angle while the outer surface tapers outward at a fourth angle. Preferably, the first and second angles are about equal but opposite, and the fourth angle is about equal to the third angle. These angles provide relief for molding the multichamber squeeze tube with the end wall and multiple tubes as a single piece in a straight draw mold.

The outer surface of the second tube adjacent the end wall has cap engaging elements such as preferably, threads, in which case the outer surface of the second tube is cylindrical. In one embodiment, the threads are formed on a cylindrical neck formed on the second tube adjacent the end wall and the second tube can have a main section and a shoulder between the main section and the neck.

In a preferred embodiment of the invention the main section of the second tube and the first tube are molded with out of round cross-sections having aligned major and minor axes. The first tube is integrally molded to the shoulder of the second tube along the major axis of the first tube and is spaced inwardly from the shoulder along the minor axis. Most preferably, the out of round first and second tubes are generally ellipsoidal in cross-section.

The invention embraces a combination of the squeeze tube with a cap which engages the neck such as by complementary threads on the inner surface of a peripheral skirt.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 3:
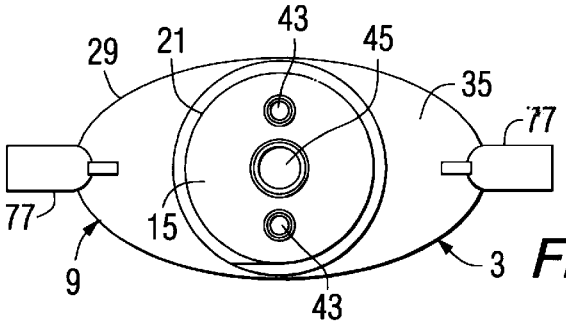
FIG. 3 is a top plan view of the twin chamber container.
Figure 1:
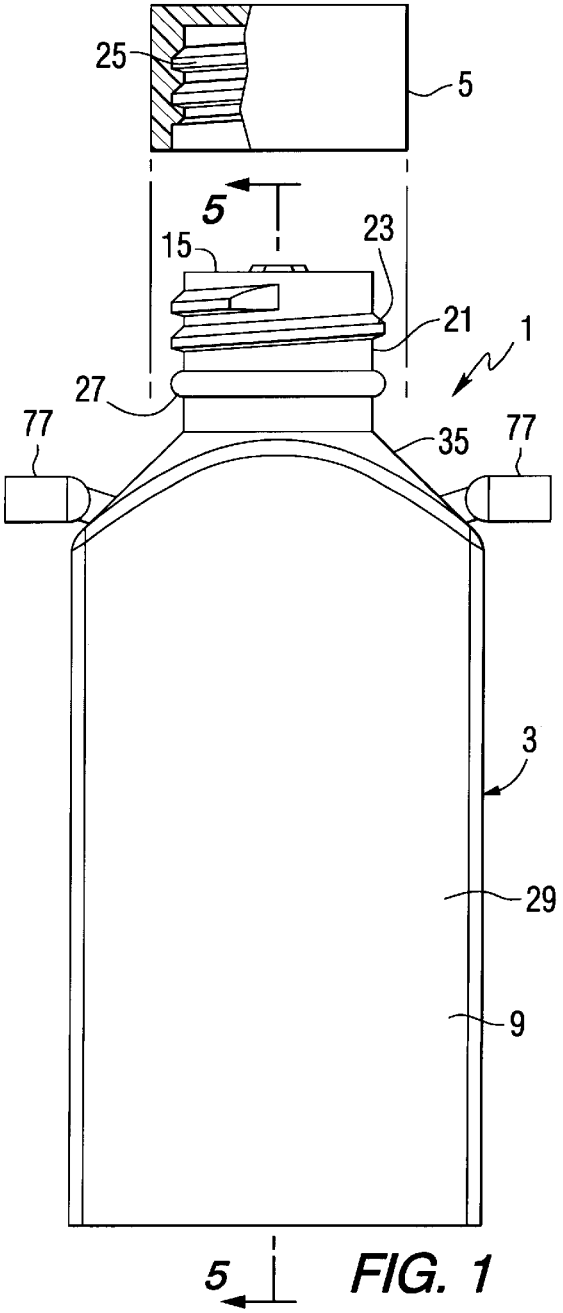
FIG. 1 is an exploded front elevation view with part cut away of a container assembly in accordance with the invention.

Referring to FIGS. 1–6, the container 1 of the invention includes a multichamber squeeze tube 3 and a cap 5. The multichamber squeeze tube 3 has a first, inner tube 7 nested inside of a second, outer tube 9. A first chamber 11 is formed inside the inner tube 7 and a second chamber 13 is formed between the inner tube 7 and the outer tube 9. The first and second tubes 7 and 9 are integrally molded with an end wall 15 extending along first or upper ends 17 and 19 of the tubes 7 and 9. This end wall 15 closes off the upper ends of the first and second chambers 11 and 13. The second or outer tube 9 is formed with a cylindrical neck 21 at the upper end having integrally molded external threads 23 for engaging internal threads 25 in the cap 5. The neck 21 also has an annular bead 27 below the threads 23. Other devices can be used for securing the cap to the neck of the container such as, for example, a snap connection.

Figure 5:
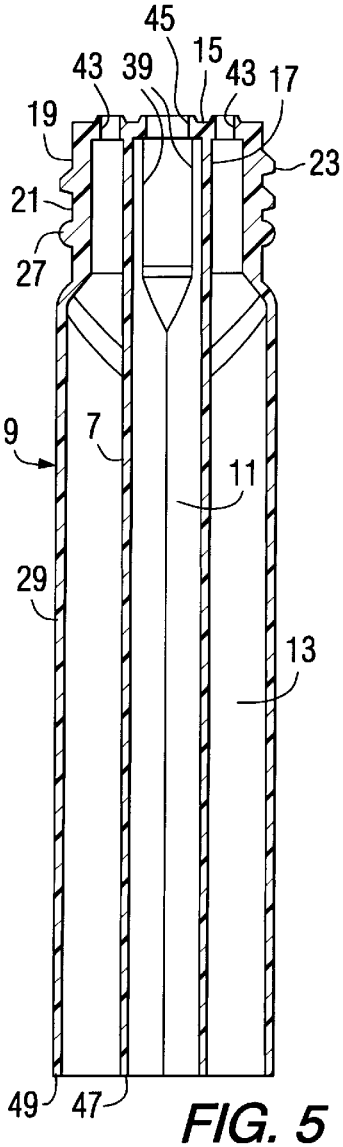
FIG. 5 is a vertical section taken at right angles to the section of FIG. 4 along the line 5—5 in FIG. 1.
Figure 2:
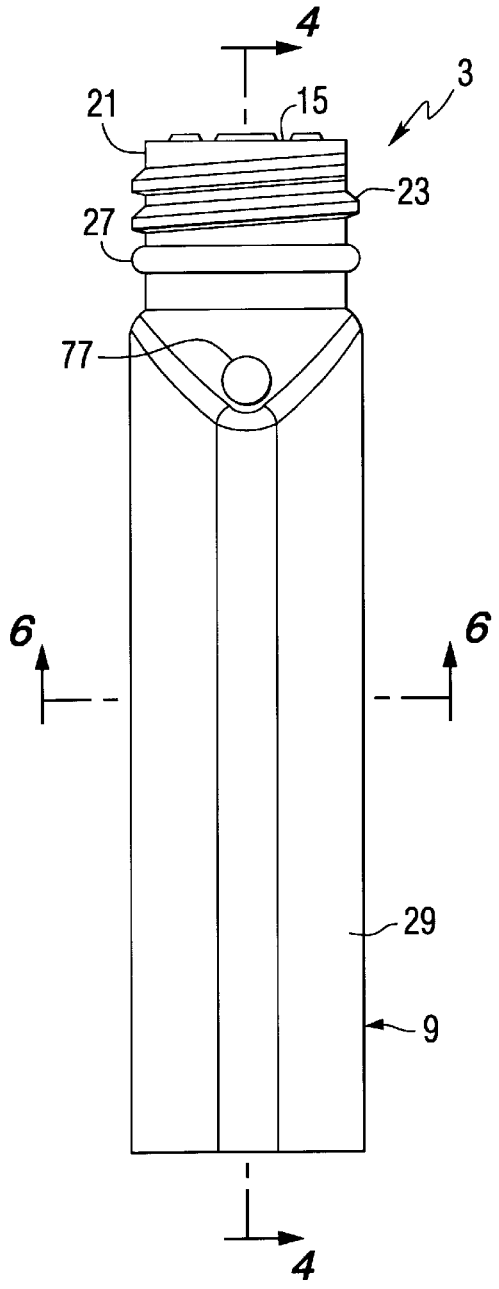
FIG. 2 is a side elevation view of the twin chamber container which forms part of the container assembly of FIG. 1.
Figure 4:
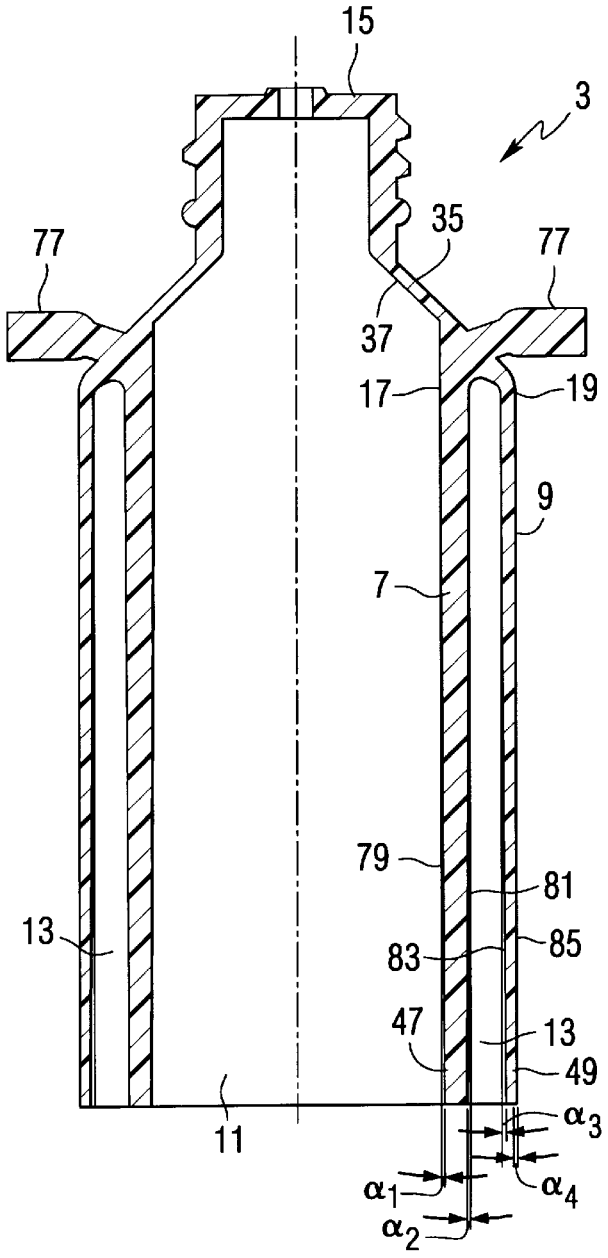
FIG. 4 is a vertical section through the multichambered container taken along the line 4—4 in FIG. 2.
Figure 6:
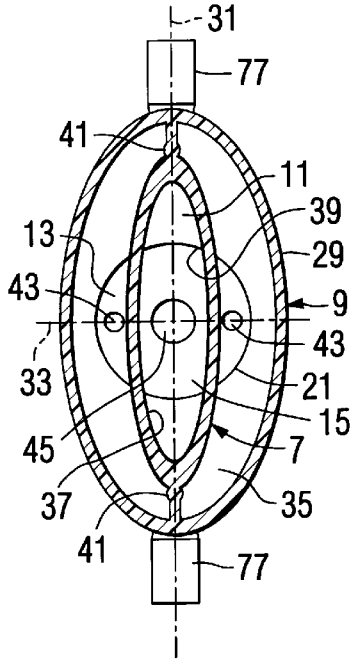
FIG. 6 is a cross-sectional view looking upward taken along the line 6—6 in FIG. 2.

As best seen in FIG. 6, a main section 29 of the outer tube 9 and the inner tube 7 are out of round in cross-section having aligned major and minor axes 31 and 33. The out of round main section 29 of the outer tube 9 is connected to the cylindrical neck section 21 through an integrally molded shoulder 35 (see FIGS. 1–5). The out of round inner tube 7 extends upward into the neck section 21 of the outer tube 9 to the end wall 15 as shown in FIG. 5. This inner tube 7 is integrally molded with the shoulder 35 along the major axis 31 of the inner tube at 37 (see FIG. 4). The out of round inner tube 7 intersects the cylindrical neck along the lines 39 (see FIG. 5).

Figure 9:
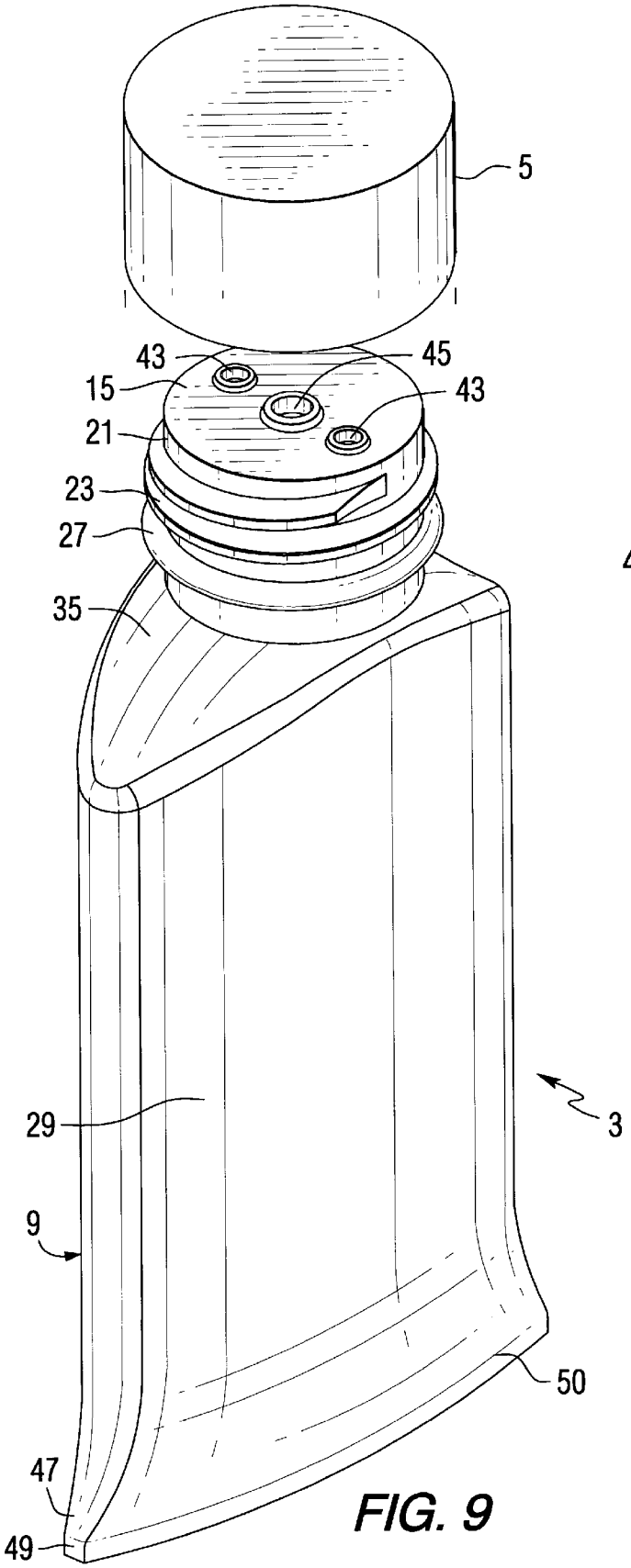
FIG. 9 is an isometric view of completed container assembly in accordance with the invention.

As best seen in FIG. 6, the out of round tube 7 and main section 29 of the tube 9 are preferably ellipsoidal in cross-section, although other out of round cross-sections such as lenticular cross-sections could be used. Longitudinal beads or flow ribs 41 can extend along the inner tube 7 at the ends of the major axis 31. The minor axis 33 of the inner tube 7 is shorter than the inside diameter of the neck portion 21 on the outer tube 9. Thus, the second chamber 13 extends up along side of the first chamber 11 to the end wall 15. The end wall 15 has apertures 43 therethrough communicating with the second chamber 13 and a central opening aperture 45 which communicates with the first chamber 11. The number and size of the apertures 43 and 45 can be selected to provide a desired ratio of product dispensed from the chambers 11 and 13. The sizing of these apertures also depends on the relative viscosity of the flowable products. With the cap 5 in place, the chambers 11 and 13 can be filled from the second ends 47 and 49 of the tubes 7 and 9 with the two flowable products. The chambers are closed by flattening the second ends 47 and 49 and then sealing them such as at 50 in FIG. 9.

Figure 7:
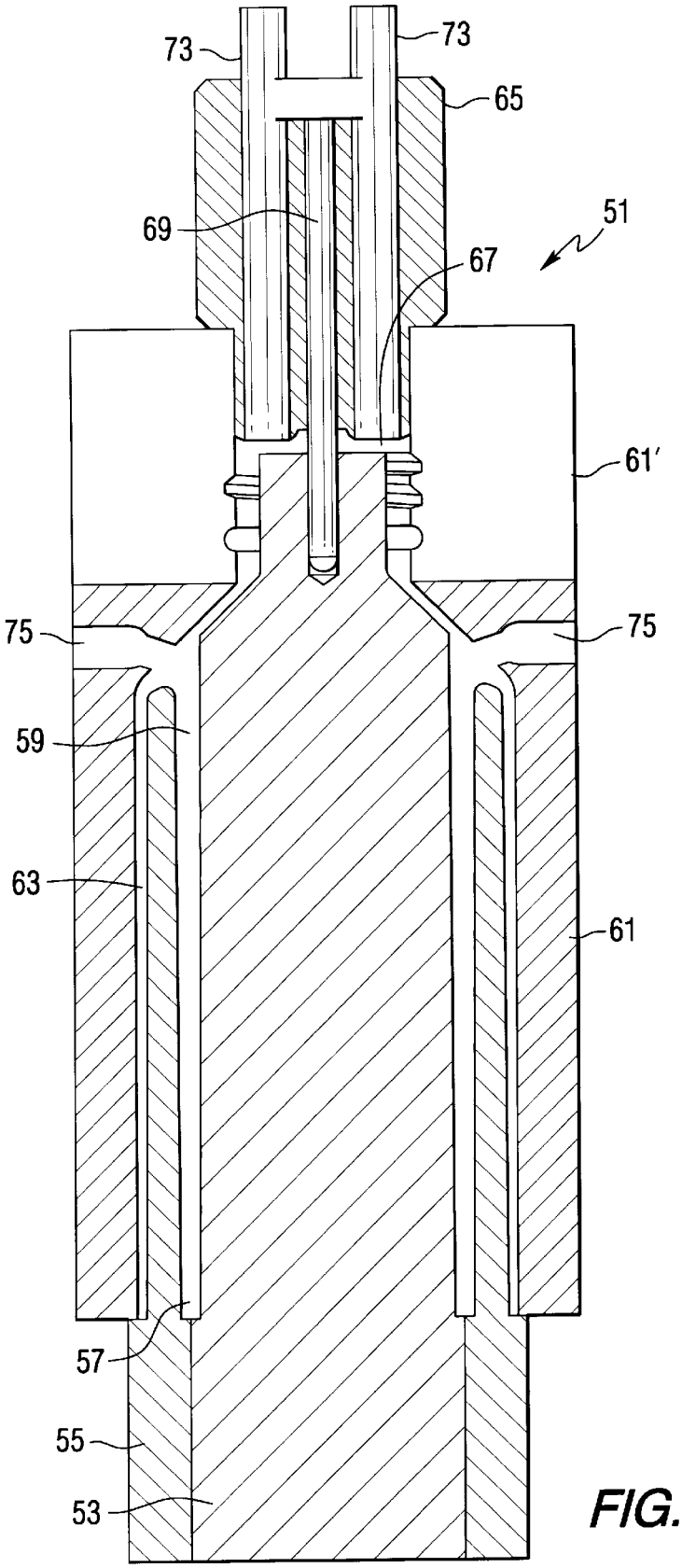
FIG. 7 is a vertical section through a mold which can be used to produce the multichambered container of the invention.
Figure 8:
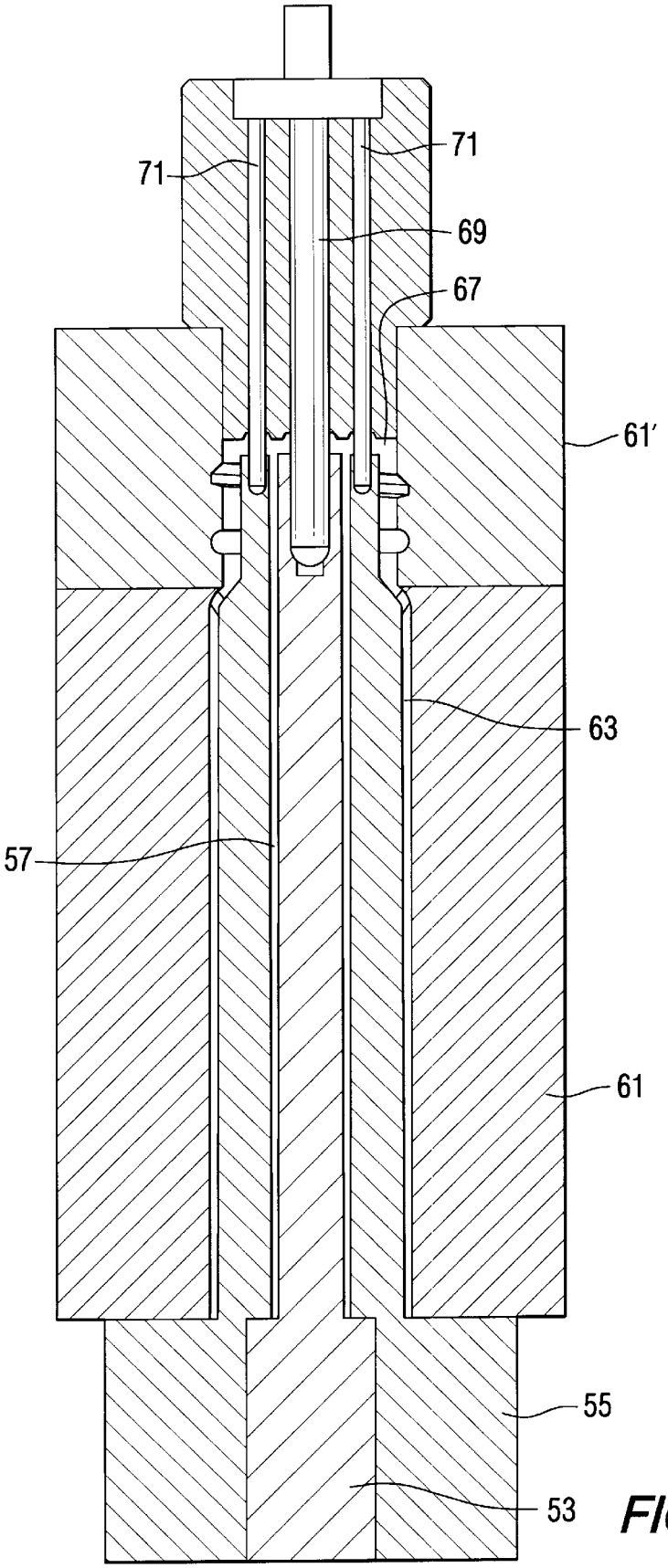
FIG. 8 is another cross-section through the mold taken at right angles to the view of FIG. 7.

As mentioned, an important part of the invention is that the multichamber squeeze tube 3 is molded as a single unit. FIGS. 7 and 8 illustrate a mold 51 for forming the multichamber squeeze tube 3. The mold 51 includes an inner core 53 and an outer core 55 which between them form a cavity 57 in which the first, or inner tube 7 is formed. The outer core 55 has a recess 59 within which the beads 41 are formed. The mold 51 also includes a cavity member 61 in which the cores 53 and 55 are inserted. The space 63 between the outer core 55 and the cavity member 61 provide the space in which the outer tube 9 is formed including the shoulder and the neck. In order to remove the external threads 23 formed on the neck 21, the upper part 61' of the cavity member 61 is split along the plane of FIG. 7.

A cavity insert 65 extends into a recess in the top of the cavity member 61 and is spaced from the top of the inner core 53 to form the space 67 for the end wall. A core pin 69 extends down from the cavity insert 65 into the center of the inner core 53 to form the aperture 45. Two additional core pins 71 (see FIG. 8) form the apertures 43. A pair of ejector pins 73 also extend through the cavity insert 65 for ejecting the multichamber squeeze tube 3 from the cavity member 61. Alternatively, the cavity member 61 can be split throughout its length along the plane of FIG. 7 and then the ejector pins 73 would not be needed.

With the mold 51 assembled, as shown in FIGS. 7 and 8, a resin is injected into the cavities formed by the mold through the runners 75. Examples of suitable resins for molding the multichamber squeeze tube 3 are linear low density polyethylene, low density polyethylene, general purpose polypropylene, and high density polyethylene. Once the resin is set, the inner core 53 and outer core 55 are removed. Then the two halves of the cavity member 61 can be separated to remove the part. Once the part has been removed, the runners 77 are sheared off.

The multichamber squeeze tube 3 of the invention can be easily formed as a single piece. A straight draw mold can be used for forming the single piece with only the split sections of the mold needed if threads or other projections are provided on the neck. In order to assist in removing the multichamber squeeze tube from the mold 51, draft is provided on the tube walls. As can be seen from FIG. 4, the inner surface 79 of the inner tube 7 tapers outward at an angle $\alpha_1$ from the first or upper end 17 to the second or lower end 47. The outer surface 81 of this inner tube 7 on the other hand tapers inwardly from the upper end 17 to the lower end 47 at an angle $\alpha_2$. The inner surface 83 and outer surface 85 of the outer second or outer tube 9 both taper outwardly from the upper end 19 to the lower end 49 at angles $\alpha_3$ and $\alpha_4$. These draft angles are typically between about ⅛ and 1 degrees, and preferably ½ degree. The angles $\alpha_3$ and $\alpha_4$ can be equal, and the angles $\alpha_1$ and $\alpha_2$ can be equal but opposite.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A multichamber squeeze tube for containing and dispensing multiple flowable products, comprising:

at least two nested tubes having first and second ends including a first tube inside a second tube, said first and second tubes forming at least a first chamber inside said first tube for containing a first flowable product and a second chamber between said first and second tubes containing a second flowable product, and an end wall integrally molded with said first and second tubes and extending across said first ends of said first and second tubes to close off said first and second chambers, said end wall having first dispensing opening means extending into said first chamber and second dispensing opening means extending into said second chamber, and means closing off said second ends of said first and second tubes.

2. The multichamber squeeze tube of claim 1 adapted for use with a closure wherein said second tube has closure engaging elements integrally molded in an outer surface adjacent said end wall.

3. The multichamber squeeze tube of claim 2 wherein said closure engaging elements comprise threads.

4. The multichamber squeeze tube of claim 1 wherein said first tube has an inner surface which tapers outward from said first end toward said second end at a first angle and an outer surface which tapers inward from said first end to said second end at a second angle while said second tube has an inner surface which tapers outward from said first end to said second end at a third angle and an outer surface which also tapers outward from said first end to second end at a fourth angle.

5. The multichamber squeeze tube of claim 4 wherein said third and fourth angles are about equal.

6. The multichamber squeeze tube of claim 4 wherein said fourth angle is greater than said third angle.

7. The multichamber squeeze tube of claim 1 wherein said second tube is molded with a cylindrical neck section adjacent said end wall, a main section with a greater cross-sectional area than said cylindrical neck section, and a shoulder section between said neck section and said main section.

8. The multichamber squeeze tube of claim 7 adapted for use with a cap wherein said neck section has cap engaging elements on an outer surface.

9. The multichamber squeeze tube of claim 8 wherein said closure engaging elements comprise threads.

10. The multichamber squeeze tube of claim 7 wherein said main section of said second tube is molded with an out of round cross-section having a major axis and a minor axis, and wherein said first tube is also molded with an out of round cross-section having a major axis and minor axis aligned with the major and minor axes, respectively, of said main section of the second tube, said first tube being integrally molded to said shoulder along said major axis and spaced inwardly from said shoulder along said minor axis.

11. The multichamber squeeze tube of claim 10 wherein said out of round cross-sections of said first tube and said main section of said second tube are generally ellipsoidal.

12. The multichamber squeeze tube of claim 1 wherein said second ends of said first and second tubes opposite said end wall are flattened to enclose a first flowable product within said first chamber and a second flowable product within said second chamber and wherein said means closing off said second ends of said first tube and second tube comprise a seal sealing said flattened ends.

13. A container assembly comprising:

a dual chamber squeeze tube having a first tube nested inside a second tube to form a first chamber inside the first tube and a second chamber between said first tube and said second tube, and an end wall extending across first ends of said first tube and said second tube to close off first ends of said first and second chambers, said first and second tubes and said end wall being integrally molded as a single piece, said second tube having cap engaging elements on an outer surface adjacent said end wall, said end wall being formed with at least one first dispensing opening extending therethrough and aligned with said first chamber, and at least one second dispensing opening extending therethrough and aligned with said second chamber; and a cap having a cap end wall, a peripheral skirt extending from said cap end wall and tube engaging elements on an inner surface of said skirt for engaging said cap engaging elements on said second tube to secure said cap to said second tube with said cap end wall overlaying said squeeze tube end wall to close off said first and second dispensing openings.

14. The container assembly of claim 13 wherein said second tube is cylindrical adjacent said end wall, said cap skirt is cylindrical, and said cap engaging elements and tube engaging elements comprise complementary threads.

15. The container assembly of claim 14 wherein said cylindrical section adjacent said end wall forms a neck on said second tube, and wherein said second tube has a main section larger in cross-section than said neck section and a shoulder section joining said main section and said neck section.

16. The container assembly of claim 13 wherein said first tube has an inner surface which tapers outward from said first end toward said second end at a first angle and an outer surface which tapers inward from said first end to said second end at a second angle while said second tube has an inner surface which tapers outward from said first end to said second end at a third angle.

17. The container assembly of claim 16 wherein said first and second angles are about equal but opposite.

18. The container assembly of claim 16 wherein said second tube has an outer surface which tapers outward from said first end toward said second end at a fourth angle which is about equal to said third angle.

19. The container assembly of claim 15 wherein said main section of said second tube is molded with an out of round cross-section having a major axis and a minor axis, and wherein said first tube is also molded with an out of round cross-section having a major axis and minor axis aligned with the major and minor axes, respectively, of said main section of the second tube, said first tube being integrally molded to said shoulder along said major axis and spaced inwardly from said shoulder along said minor axis.

20. The container assembly of claim 19 wherein said out of round first and second tubes are generally ellipsoidal in cross-section.

* * * * *